US010995992B2

(12) United States Patent
He et al.

(10) Patent No.: US 10,995,992 B2
(45) Date of Patent: May 4, 2021

(54) SINTERING FURNANCE

(71) Applicant: Liaoning Upcera Co., Ltd., Benxi (CN)

(72) Inventors: Lingling He, Benxi (CN); Wanting Xia, Benxi (CN); Ying Guo, Benxi (CN); Yingying Bai, Benxi (CN); Chengwei Han, Benxi (CN); Dapeng Yuan, Benxi (CN)

(73) Assignee: LIAONING UPCERA CO., LTD, Liaoning (CN)

( * ) Notice: Subject to any disclaimer, the term of this patent is extended or adjusted under 35 U.S.C. 154(b) by 120 days.

(21) Appl. No.: 16/324,547

(22) PCT Filed: Jun. 6, 2017

(86) PCT No.: PCT/CN2017/087301
§ 371 (c)(1),
(2) Date: Feb. 8, 2019

(87) PCT Pub. No.: WO2018/028286
PCT Pub. Date: Feb. 15, 2018

(65) Prior Publication Data

US 2019/0219336 A1 Jul. 18, 2019

(30) Foreign Application Priority Data

Aug. 10, 2016 (CN) ..... 201620858554.X

(51) Int. Cl.
*F27D 99/00* (2010.01)
*F27B 17/00* (2006.01)
(Continued)

(52) U.S. Cl.
CPC ..... *F27D 99/0073* (2013.01); *F27B 17/00* (2013.01); *F27B 17/0033* (2013.01);
(Continued)

(58) Field of Classification Search
CPC ..... F27D 99/0073
See application file for complete search history.

(56) References Cited

U.S. PATENT DOCUMENTS 3,441,652 A * 4/1969 Eicker ..... A61C 13/20 219/390
3,655,941 A * 4/1972 Schaun ..... A61C 13/20 219/390
(Continued)

FOREIGN PATENT DOCUMENTS

CN 201892412 U 7/2011
CN 203947155 U 7/2011
(Continued)

OTHER PUBLICATIONS

Liu, Liyan, International Search Report for PCT/CN2017/087301, dated Sep. 20, 2017, State Intellectual Property Office of the P. R. China, China.
(Continued)

*Primary Examiner* — Nathaniel Herzfeld
(74) *Attorney, Agent, or Firm* — Cittone Demers & Arneri, LLP; Henry J. Citone

(57) ABSTRACT

Disclosed is a sintering furnace comprising a furnace body and a lifting device, wherein the furnace body comprises a furnace chamber (10) and a furnace mouth (20), the furnace chamber (10) is connected with the furnace mouth (20), wherein the sintering furnace further comprises a sealing member (30) provided at the lifting device; when the sintering furnace is in a loading or unloading condition, the sealing member (30) blocks the furnace mouth (20). When the sintering furnace is in an unloading condition, the sealing member (30) can block the furnace mouth (20), the furnace chamber (10) does not contact with the outside directly, thus the temperature in the furnace chamber (10) will not drop
(Continued)

sharply, and the service life of the sintering furnace will be increased.

9 Claims, 3 Drawing Sheets

(51) Int. Cl.
*F27B 17/02* (2006.01)
*F27D 3/00* (2006.01)

(52) U.S. Cl.
CPC ..... *F27B 17/02* (2013.01); *F27B 17/025* (2013.01); *F27D 3/00* (2013.01); *F27D 2003/0086* (2013.01); *F27D 2099/0078* (2013.01); *F27M 2003/04* (2013.01)

(56) References Cited

U.S. PATENT DOCUMENTS

| | | | | | |
|---|---|---|---|---|---|
| 3,860,738 | A * | 1/1975 | Hintenberger | A61C 13/20 | 219/390 |
| 4,417,346 | A * | 11/1983 | Giler | F27B 14/06 | 373/130 |
| 5,313,048 | A * | 5/1994 | Berg | G01N 1/44 | 219/385 |
| 5,613,776 | A * | 3/1997 | Turner | G01M 99/002 | 165/61 |
| 6,252,202 | B1 * | 6/2001 | Zychek | F27B 17/025 | 219/385 |
| 8,109,761 | B1 * | 2/2012 | Neal | F27D 9/00 | 432/205 |
| 8,890,036 | B2 * | 11/2014 | Serrago | F27B 5/04 | 219/390 |
| 2007/0082307 | A1 * | 4/2007 | Zubler | A61C 13/20 | 431/120 |
| 2007/0175232 | A1 * | 8/2007 | Schultz | G01M 99/002 | 62/282 |
| 2016/0187244 | A1 * | 6/2016 | Seok | G01N 3/60 | 73/863.11 |

FOREIGN PATENT DOCUMENTS

| | | | |
|---|---|---|---|
| CN | 203947155 | U | 11/2014 |
| CN | 104596246 | A | 5/2015 |
| CN | 201892412 | | 5/2015 |
| CN | 105067657 | | 11/2015 |
| CN | 105067657 | B | 11/2015 |
| CN | 104596246 | | 3/2017 |
| CN | 206019324 | U | 3/2017 |
| EP | 3388767 | | 11/2014 |
| JP | S6247403 | A | 3/1987 |
| JP | S6247403 | A | 3/1987 |
| JP | H10213376 | A | 8/1998 |
| JP | 2003314963 | A | 11/2003 |
| KR | 20080073084 | A | 8/2008 |
| KR | 101533939 | B1 | 7/2015 |
| WO | 2018076919 | | 5/2018 |

OTHER PUBLICATIONS

Liu, Liyan, Written Opinion of the International Searching Authority for PCT/CN2017/087301, dated Sep. 20, 2017, State Intellectual Property Office of the P. R. China, China.

Tang, Xiaofan, International Preliminary Report on Patentability for PCT/CN2017/087301, dated Sep. 20, 2017, State Intellectual Property Office of the P. R. China, China.

Stefano Peis, Sintering Furnace, Supplementary European Search Report, dated May 20, 2019, European Patent Office, Munich Germany.

* cited by examiner

SINTERING FURNANCE

CROSS-REFERENCE TO RELATED APPLICATIONS

This application is the U.S. National Stage of PCT International Patent Application No. PCT/CN2017/087301, filed Jun. 6, 2017, which claims priority to Chinese Patent Application No. 201620858554.X, filed Aug. 10, 2016, the disclosures of each of which are incorporated herein by reference in their entirety.

The present application claims the priority of a Chinese patent application No. 201620858554.X, filed with the China National Intellectual Property Administration on Aug. 10, 2016 and entitled "Sintering Furnace", which is incorporated herein by reference in its entirety.

TECHNICAL FIELD

The application relates to the field of a sintering device, in particular to a sintering furnace.

BACKGROUND

Zirconia ceramic has high strength and a certain light transmittance, and has been widely used in zirconia restorations in prosthodontics. Zirconia restorations need to be sintered during their manufacturing processes.

The existing ceramic sintering device generally includes a furnace body and a lifting device. The furnace body includes a furnace chamber, a heating element and a furnace mouth, wherein the heating element is located in the furnace chamber for heating the furnace chamber and the furnace chamber is connected with the furnace mouth. When loading and unloading, the lifting device is detached from the furnace body to facilitate the loading and removal of sintered samples. When sintering, the lifting device is raised to a sintering position, and a sample to be sintered is fed into the furnace chamber through the furnace mouth for sintering.

In order to speed up the sintering process and reduce sintering time, the lifting device is usually quickly lowered to a loading position after the furnace chamber is pre-heated to a preset temperature; the lifting device is raised to the furnace chamber for sintering after zirconia restorations to be sintered are placed on the lifting device; after the sintering finishes, the lifting device is lowered to an unloading position, and the sintered samples are cooled down.

When the lifting device is lowered to the unloading position, the lifting device is completely detached from the furnace mouth, the furnace chamber is open, and thus the temperature drops sharply, which causes great damage to refractories and heating elements of the furnace chamber and reduces the service life. At the same time, since the temperature of the furnace chamber drops sharply, it takes a long time for the furnace chamber to be heated up again to the required temperature for sintering zirconia restorations. The whole sintering process generally takes 6 to 10 hours, which cannot achieve a rapid sintering process less than 20 minutes.

SUMMARY

The purpose of the embodiments of the present application is to provide a sintering furnace for solving the problems of short service life and long sintering time of the existing ceramic sintering devices. The technical solutions are as follows.

A sintering furnace including a furnace body and a lifting device, wherein the furnace body includes a furnace chamber and a furnace mouth, the furnace chamber is connected with the furnace mouth, wherein the sintering furnace further includes a sealing member provided at the lifting device; when the sintering furnace is in a loading or unloading condition, the sealing member blocks the furnace mouth.

In a preferable embodiment of the present application, the sealing member includes a plug and at least two support rods, each support rod has a lower end fixedly connected to the lifting device and an upper end fixedly connected to the plug, the sealing member blocks the furnace mouth through the plug.

Optionally, the support rods are ceramic support rods.

Optionally, the plug is an alumina ceramic fiber plug or a polycrystalline mullite fiber plug.

In a preferable embodiment of the present application, the sealing member and the lifting device are formed in one piece with a sample space provided therein for placing a sintered sample.

Optionally, the sample space is a through hole extending in a horizontal direction.

Optionally, the sealing member is an alumina ceramic fiber sealing member or a polycrystalline mullite fiber sealing member.

Optionally, the lifting device includes a lifting platform and a driver for driving the lifting platform to go up and go down.

The lifting platform is a stepped lifting platform with an upper end smaller than a lower end, the sealing member is provided at the upper end of the lifting platform, when the sintering furnace is in a sintering condition, the upper end of the lifting platform is inserted into the furnace mouth, and a step surface of the lower end abuts against an outer surface of the furnace body.

Optionally, the lifting platform is a thermal insulating lifting platform.

Optionally, the lifting device further includes cooling fans, which are uniformly distributed on a peripheral wall of the lower end of the lifting platform.

Embodiments of the present application provide a sintering furnace including a furnace body and a lifting device, wherein the furnace body includes a furnace chamber and a furnace mouth that are connected with each other, wherein the sintering furnace further includes a sealing member provided at the lifting device; when the lifting device is in a loading or unloading position, the sealing member blocks the furnace mouth. It can be seen that in this solution, when the sintering furnace is in an unloading condition, the sealing member can block the furnace mouth, the furnace chamber does not contact with the outside directly, thus the temperature in the furnace chamber will not drop sharply, and the service life of the sintering furnace will be increased. At the same time, it is also possible to rapidly raise to the required temperature for sintering the zirconia restorations, which greatly shortens the sintering time.

BRIEF DESCRIPTION OF DRAWINGS

In order to describe the embodiments of the present application or the technical solutions in the prior art more clearly, drawings required for describing embodiments of the present application or the prior art will be described briefly below. It is obvious that the drawings below are for only some embodiments of the present application, and those skilled in the art can also obtain further drawings based on these drawings without any creative efforts.

DETAILED DESCRIPTION

The technical solutions in the embodiments of the present application will be described clearly and completely below with reference to the accompanying drawings in the embodiments of the present application. Obviously, the described embodiments are only some of the embodiments of the present application, rather than all of the embodiments. All other embodiments obtained based on the embodiments of the present application by those skilled in the art without any creative efforts fall into the protection scope defined by the present application.

It should be noted that, "loading or unloading condition" herein refers to the working condition of a sintering furnace when a lifting device of the sintering furnace is lowered to the loading or unloading position, and "sintering condition" refers to the working condition of a sintering furnace when the lifting device of the sintering furnace is raised to the sintering position.

Figure 1:
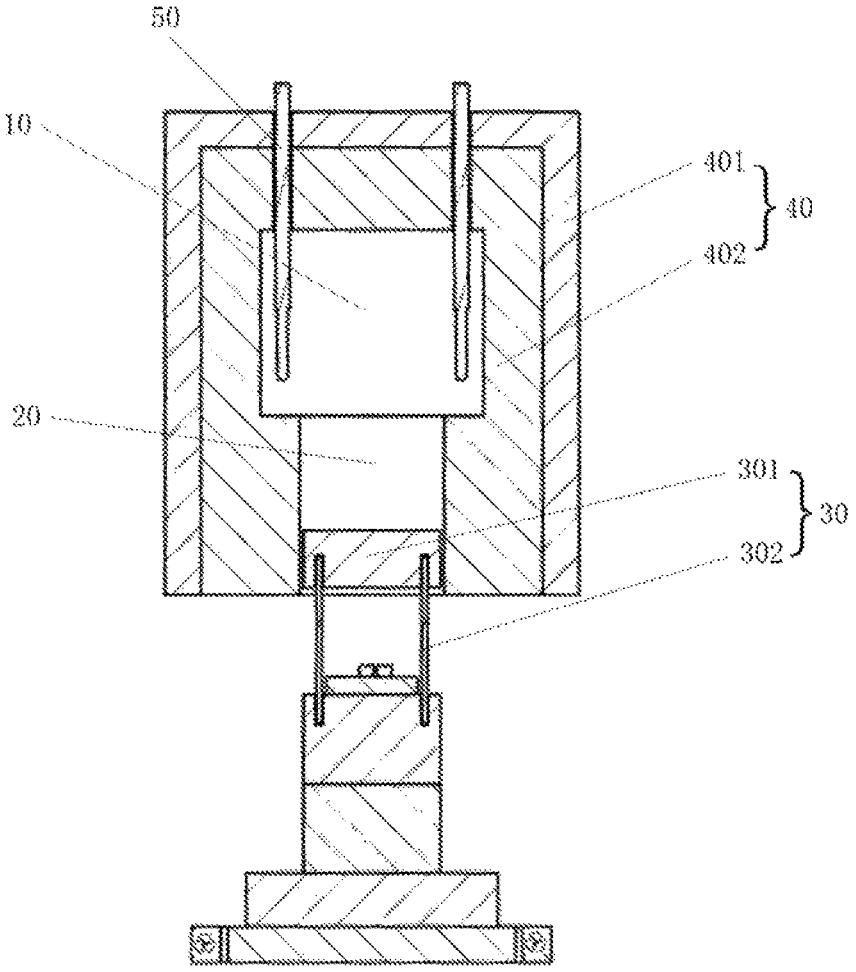
FIG. 1 is a schematic structural diagram of a specific embodiment of a sintering furnace provided in this application.
Figure 2:
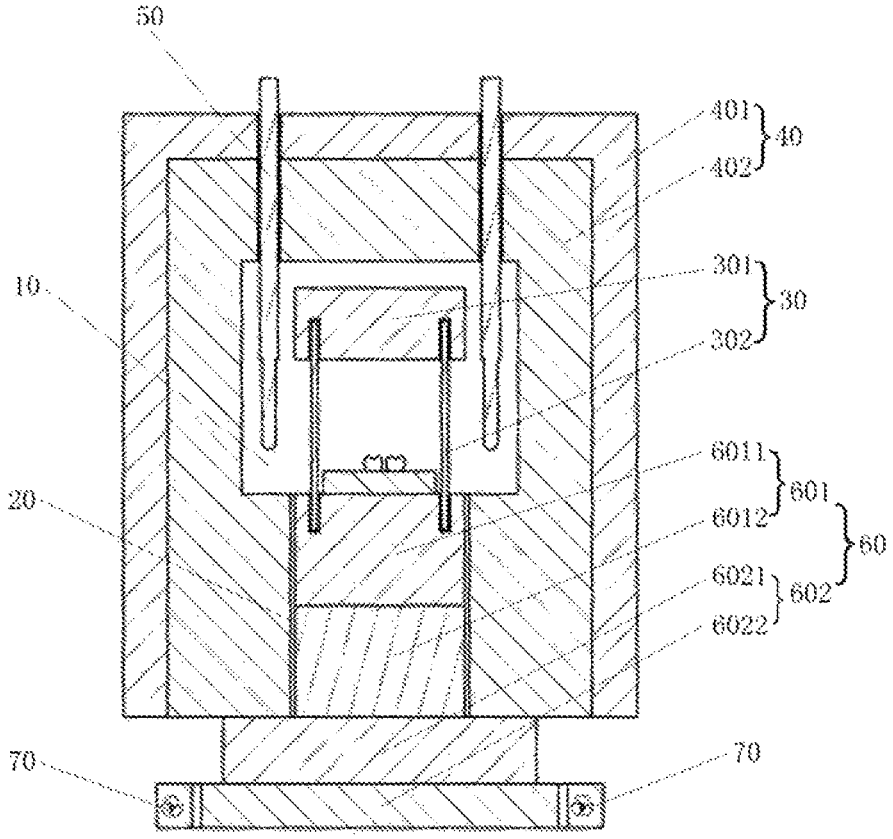
FIG. 2 is a schematic structural diagram of the sintering furnace shown in FIG. 1 in a sintering condition.

Referring to FIGS. 1 and 2, FIG. 1 is a schematic structural diagram of a specific embodiment of a sintering furnace provided in this application, and FIG. 2 is a schematic structural diagram of the sintering furnace shown in FIG. 1 in a sintering condition.

In this specific embodiment, as shown in FIG. 1, the sintering furnace includes a furnace chamber 10 and a furnace mouth 20, wherein the furnace chamber 10 is connected with the furnace mouth 20. The sintering furnace further includes a sealing member 30, which is provided in a lifting device. When the sintering furnace is in a loading or unloading condition, the sealing member 30 blocks the furnace mouth 20.

It can be seen that the sintering furnace is in the unloading condition, the sealing member can block the furnace mouth, the furnace chamber does not contact with the outside directly, thus the temperature in the furnace chamber will not drop sharply, and the service life of the sintering furnace will be increased. At the same time, it is also possible to rapidly raise to the required temperature for sintering the zirconia restorations, which greatly shortens the sintering time.

Specifically, the sealing member 30 includes a plug 301 and at least two support rods 302, each of which has a lower end fixedly connected to the lifting device and an upper end fixedly connected to the plug 301. When the sintering furnace is in the loading or unloading condition, the sealing member 30 can block the furnace mouth 20 through the plug 301. The support rods 302 may be ceramic support rods or other heat-resistant support rods, which are not limited herein. The plug 301 may be made of a heat-resistant material, such as an alumina ceramic fiber plug or a polycrystalline mullite fiber plug, which are not limited herein.

In practical applications, the plug 301 is fixed on the upper end of the lifting device through the support rods 302, and forms a certain space with the upper end surface of the lifting device, so that the sample can be conveniently loaded and removed. As can be understood, the size of the plug 301 is the same as the caliber of the furnace mouth 20. After the end of the sintering, the lifting device is lowered to the unloading position, and then the plug 301 can block the furnace mouth 20, which reduces the heat exchange between the furnace chamber and the outside.

The sintering furnace further includes a furnace body 40 and a heating element 50, wherein the furnace body 40 may be composed of a sheath 401 and thermal insulating layer 402, which can reduce the heat exchange between the furnace chamber 10 and the outside when sintering a sample and ensure the temperature within the furnace chamber 10. Specifically, the sheath 401 and thermal insulating layer 402 may be made of high-temperature resistant lightweight refractories. For example, the sheath 401 may be made of alumina ceramic fiber refractories, and the thermal insulating layer 402 may be made of polycrystalline mullite fiber refractories, which are not limited herein.

As shown in FIG. 2, in this specific embodiment, the lifting device may include a lifting platform 60 and a driver (not shown in the figure) for driving the lifting platform 60 to go up and go down. The driver may be an existing driving device, such as a driving device with a mechanical arm, a hydraulic driving device or the like, as long as it can drive the lifting platform 60 to go up and go down, which are not limited herein. Specifically, the lifting platform 60 may be a stepped lifting platform with the upper portion smaller than the lower portion, and the sealing member 30 is provided at the upper end of the lifting platform 60. The "stepped lifting platform with the upper portion smaller than the lower portion" herein refers to that the upper end 601 of the lifting platform 60 is smaller than the lower end 602. Specifically, the size of the upper end 601 of the lifting platform 60 is the same as the caliber of the furnace mouth 20, while the size of the lower end 602 is larger than the caliber of the furnace mouth 20.

When the sintering furnace is in the sintering condition, the upper end 601 of the lifting platform 60 is inserted into the furnace mouth 20, and a step surface of the lower end 602 abuts against an outer surface of the furnace body 40. On the one hand, the insertion of the upper end 601 of the lifting platform 60 into the furnace mouth 20 allows to feed a sample into the furnace chamber 10 for sintering. On the other hand, the furnace mouth 20 is blocked by the upper end 601 of the lifting platform 60 which can reduce the heat exchange between the furnace chamber and the outside during the sintering process, and the step surface of the lower end 602 abuts against the outer surface of the furnace body 40 which can further close the furnace chamber, reduce heat loss and speed up the sintering process.

It should be noted that, the lifting platform 60 is made of a high-temperature insulation material. For example, it may be a lifting platform made of an alumina ceramic fiber refractory or a polycrystalline mullite fiber refractory, which is not limited herein.

For the convenience of installation and removal, the upper end 601 of the lifting platform 60 may include two parts, i.e., the upper portion 6011 and the lower portion 6012. The lower end of the support rod 302 may be fixedly connected to the upper portion 6011 of the upper end 601 of the lifting platform 60.

Further, the lower end 602 of the lifting platform 60 may also include two parts, i.e., the upper portion 6021 and the lower portion 6022. When the sintering furnace is in the sintering condition, the step surface of the upper portion 6021 of the lower end 602 abuts against the outer surface of the furnace body 40.

Further, the lifting device may further include cooling fans 70, which may be uniformly distributed on a peripheral wall of the lower end 602 of the lifting device 60 for cooling the lifting platform 60 and thus the sintered sample when the sintering furnace is in the unloading condition. After the temperature of the sample drops to a certain temperature, the sample may be directly placed at the cooling fans 70 to quickly cool the sample. Specifically, the cooling fans 70 may be uniformly distributed on the peripheral wall of the lower portion 6022 of the lower end 602 of the lifting platform 60, which can avoid the direct contact of the cooling fans 70 with the furnace body 40 when sintering a sample, and prevent the cooling fans 70 from being damaged at high temperatures.

It should be noted that the cooling fans 70 may be any existing cooling fan, as long as it can achieve the purpose of cooling, which is not specifically limited herein. The number of cooling fans 70 is not specifically limited in the present application, it can be determined by a person skilled in the art based on factors such as the type of the sample and cooling requirements.

Figure 3:
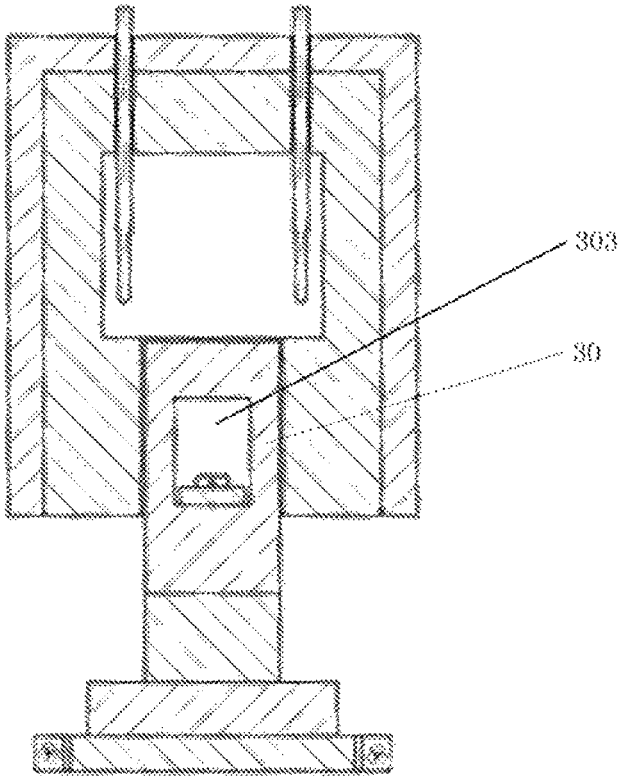
FIG. 3 is a schematic structural diagram of another sintering furnace provided in this application.

In another specific embodiment of the present application, as shown in FIG. 3, the sealing member 30 and the lifting device are formed in one piece and a sample space 303 is provided therein for placing the sintered sample. Specifically, the sample space 303 is a through hole extending in a horizontal direction. Its shape and size are not specified herein as long as the sintered sample can be put in and taken out from this space. The sealing member 30 may be an alumina ceramic fiber sealing member or a polycrystalline mullite fiber sealing member, or other sealing member made of a high-temperature resistant material, which is not limited herein.

As can be understood, the size of the sealing member 30 is the same as the caliber of the furnace mouth 20. After the end of sintering, the lifting device is lowered to the unloading position, and then the sealing member 30 can block the furnace mouth 20, which reduces the heat exchange between the furnace chamber and the outside.

It should be noted that in this embodiment, the structures of the furnace body and the lifting device of the sintering furnace are identical to those of the furnace body and the lifting device of the sintering furnace shown in FIGS. 1 and 2. From the description of the furnace body and the lifting device of the sintering furnace shown in FIGS. 1 and 2, a person skilled in the art can undoubtedly deduce the working principle of the sintering furnace and the structures of the furnace body and the lifting device, which will not be described herein.

Further, in the embodiment, the sealing member 30 may be integrally formed with the upper portion of the upper end of the lifting platform for easy installation and processing.

It should be noted that, the terms "include", "comprise" or any variants thereof in this application are intended to cover a non-exclusive inclusion, such that processes, methods, articles or devices comprising a series of elements comprise not only those elements listed, but also other elements not specifically listed or the elements intrinsic to these processes, methods, articles, or devices. Without further limitations, elements limited by the wording "comprise(s) a/an . . . " do not exclude that there are additional identical elements in the processes, methods, articles, or devices which comprise the listed elements.

All embodiments in the description are described in a correlated manner, and the same or similar parts in various embodiments can be referred to each other, the description for each embodiment focuses on the differences from the other embodiments.

The embodiments described above are just preferable embodiments of the present application, and not indented to limit the protection scope of the present application. Any modifications, alternatives, improvements or the like made within the spirit and principle of the present application shall be comprised in the protection scope of the present application.

What is claimed is:

1. A sintering furnace comprising a furnace body and a lifting device, wherein the furnace body comprises a furnace chamber and a furnace mouth, the furnace chamber is connected with the furnace mouth, wherein the sintering furnace further comprises a sealing member provided at the lifting device; when the sintering furnace is in a loading or unloading condition, the sealing member blocks the furnace mouth;

wherein the lifting device comprises a lifting platform and a driver for driving the lifting platform to go up and go down, the lifting platform is a stepped lifting platform with an upper end smaller than a lower end, the upper end and the lower end are each provided with an upper portion and a lower portion;

a lower end of the sealing member is fixedly connected to the upper portion of the upper end of the lifting platform;

when the sintering furnace is in a sintering condition, the upper end of the lifting platform is inserted into the furnace mouth, and a step surface of the upper portion of the lower end of the lifting platform abuts against an outer surface of the furnace body.

2. The sintering furnace of claim 1, wherein the sealing member comprises a plug and at least two support rods, each support rod has a lower end fixedly connected to the lifting device and an upper end fixedly connected to the plug, the sealing member blocks the furnace mouth through the plug.

3. The sintering furnace of claim 2, wherein the support rods are ceramic support rods.

4. The sintering furnace of claim 2, wherein the plug is an alumina ceramic fiber plug or a polycrystalline mullite fiber plug.

5. The sintering furnace of claim 1, wherein the sealing member and the lifting device are formed in one piece with a sample space provided therein for placing a sintered sample.

6. The sintering furnace of claim 5, wherein the sample space is a through hole extending in a horizontal direction.

7. The sintering furnace of claim 5, wherein the sealing member is an alumina ceramic fiber sealing member or a polycrystalline mullite fiber sealing member.

8. The sintering furnace of claim 1, wherein the lifting platform is a thermal insulating lifting platform.

9. The sintering furnace of claim 1, wherein the lifting device further comprises cooling fans, which are uniformly distributed on a peripheral wall of the lower end of the lifting platform.

* * * * *